United States Patent [19]

Pershin et al.

[11] 4,207,928

[45] Jun. 17, 1980

[54] PROCESS FOR MANUFACTURING TWISTED WIRE ARTICLES WITH VARIABLE DIRECTION OF TWIST AND A MACHINE FOR ACCOMPLISHING SAME

[76] Inventors: Gennady D. Pershin, ulitsa Vokzalnaya, 144/2, kv. 2; Klim G. Zalyaljutdinov, ulitsa Moskovskaya, 16, kv. 68; Rais F. Gimazetdinov, ulitsa Shishko, 4, kv. 54; Vladimir D. Egorov, ulitsa Gryaznova, 14/1, kv. 85; Gennady K. Schegolev, prospekt K. Marxa, 136, kv. 23, all of Magnitogorsk Chelyabinskoi oblasti, U.S.S.R.

[21] Appl. No.: 946,036

[22] Filed: Sep. 26, 1978

[30] Foreign Application Priority Data

Dec. 16, 1977 [SU] U.S.S.R. ..... 2551251

[51] Int. Cl.[2] ..... B21F 7/00

[52] U.S. Cl. ..... 140/115; 140/149; 57/294

[58] Field of Search ..... 140/115, 149; 57/58.83, 57/293, 294

[56] References Cited

U.S. PATENT DOCUMENTS

| | | | |
|---|---|---|---|
| 3,133,402 | 5/1964 | Zwolinski et al. | 57/293 |
| 3,460,334 | 8/1969 | Lawrenson et al. | 57/293 |
| 3,797,217 | 3/1974 | Braun | 57/294 |
| 3,847,190 | 11/1974 | Forester | 140/149 |
| 3,884,024 | 5/1975 | Oestreich et al. | 57/294 |

*Primary Examiner*—Lowell A. Larson

*Attorney, Agent, or Firm*—Fleit & Jacobson

[57] ABSTRACT

This process provides for twisting continuously supplied wires in one of preset directions with an essentially uniform pitch of twist ensuring the maximum number of lays in the zone of preliminary twisting, while simultaneously twisting the wires in the opposite direction in the zone of final twisting of wires to form an article.

The machine for accomplishing the process comprises, sequentially mounted on a bed, an unwinding device, a twisting mechanism, a pull-out mechanism and a take-up mechanism. Arranged between the unwinding device and the twisting mechanism are guides accommodating a carriage having a reciprocation drive. According to the invention, the machine is provided with an auxiliary twisting head mounted on the carriage and provided with a drive for rotating the head synchronously with the twisting head of the twisting mechanism.

5 Claims, 2 Drawing Figures

PROCESS FOR MANUFACTURING TWISTED WIRE ARTICLES WITH VARIABLE DIRECTION OF TWIST AND A MACHINE FOR ACCOMPLISHING SAME

FIELD OF THE INVENTION

The present invention relates to processes and machines for manufacturing twisted wire articles with variable direction of twist, for example, ropes for abrasion sawing of natural stone, as well as to the manufacture of electric wires and cables.

BACKGROUND OF THE INVENTION

Widely known in the art is a process for manufacturing twisted wire articles with variable direction of twist, comprising the steps of twisting and untwisting wires in the gap between a feed mechanism and a twisting head and of forming a finished article in the zone between the twisting head and a take-up mechanism as a result of continuous movement of wires along with the production process.

A disadvantage of said prior art process consists in that the twisting and untwisting of wires in the gap between the feed mechanism and the twisting head is effected with a pitch increasing with the distance from the twisting head. This results in a reduced number of lays and restricted length of article portions twisted in a single direction which, in turn, leads to frequent reversal of the twisting process and, consequently, lower efficiency.

In the machine for accomplishing said prior art process, the alternate twisting of articles in the right- and left-hand directions is effected as a result of continuous movement of three wires along with the production process and reverse rotation of the twisting head located in the gap between the feed and take-up mechanisms, provided the distance between the feed mechanism and twisting head is considerably greater than that between the twisting head and jaws provided between the twisting head and take-up mechanism.

The period of reversing of the twisting head decreases with an increase of the speed of its rotation, however, the minimum value of the period of reversing is limited and depends on the kinematics of actuating mechanisms, which means that the speed of rotation of the twisting head is likewise limited, this serving the main obstacle to increasing the output of twisted wire articles with variable direction of twist.

Japanese Pat. No. 20672/68 teaches a process for manufacturing twisted wire articles with variable direction of twist, providing for a continuous feed of wires to the zones of preliminary and final twisting. While so doing, in the zone of preliminary twisting the wires are twisted in one of the preset directions while in the final twisting zone the wires are twisted in the opposite direction. After that, the untwisting of pre-twisted wires takes place in the preliminary twisting zone simultaneously with the twisting of wires in the opposite direction in the final twisting zone.

In addition, for increasing the efficiency of the machines designed to accomplish said process, provision is made of means for additional twisting of the article in the final twisting zone, fashioned as a rotary support mounted between the twisting jaws and pull-out mechanism.

However, the additional twisting of the article results in a non-uniform pitch of twist in a finished article and, consequently, affects the quality and performance characteristics of the finished article.

U.S.S.R. Inventor's Certificate No. 501,127 discloses a machine for manufacturing twisted wire articles with variable direction of twist. Said machine comprises an unwinding unit, a twisting mechanism, a pull-out mechanism, a take-up mechanism, twisting jaws and a twisting head.

The unwinding unit of the machine is located at a distance of 7 to 10 m from the twisting mechanism in order to ensure the pre-twisting of wires in this zone.

The maximum output of said machine is attained at the minimum permissible period of reversing of the twisting head. While so doing, the number of revolutions of the twisting head during the period of its reversing, i.e., the twisting head speed of rotation upon which the machine output ultimately depends, is equal to the number of lays of the article wires in the zone of preliminary twisting. Increasing the length of the preliminary twisting zone for increasing the number of lays therein with a view to raising the machine output is only practical up to a certain point because the dependence between the two parameters in non-linear and such that, while the distance from the twisting head increases, the increment of the number of lays of preliminary twisting corresponding to one and the same increment of the zone length gets smaller.

This sets limits on the machine output.

Besides, the length of the article portions twisted in a single direction depends directly upon the number of lays of preliminary twisting while in a number of cases when twisted articles with variable direction of twist are used, for example, sawing ropes, the length of said portions should be varied over a wide length, this being possible in the prior art machine up to a certain point only.

In view of growing demand for twisted wire articles with variable direction of twist, in particular, for ropes designed for abrasion sawing of natural stone, prior art processes and machines fail to satisfy the ever growing need for such articles. Therefore, the development of more advanced processes aimed at increasing the efficiency of manufacturing twisted wire articles with variable direction of twist is a matter of urgent necessity.

BRIEF DESCRIPTION OF THE INVENTION

It is the main object of the present invention to develop a process for manufacturing twisted wire articles with variable direction of twist, characterized by an increased efficiency and extended capabilities owing to increased length of the article portions twisted with a single direction of twist.

It is another important object of the present invention to develop a machine for manufacturing twisted wire articles with variable direction of twist, having a higher output than analogous prior art machines and extended capabilities.

The main object of the invention is attained in a process for manufacturing twisted wire articles with variable direction of twist, providing for a continuous feed of wires to series-arranged zones of preliminary and final twisting, twisting said wires in one of preset directions in the zone of preliminary twisting with an essentially uniform pitch of twist ensuring the maximum number of lays in this zone of preliminary twisting, while simultaneously twisting said wires in the opposite direction in the zone of final twisting, and subsequently untwisting the pretwisted wires in the zone of preliminary twisting while simultaneously twisting the wires in the opposite direction in the zone of final twisting of wires to form an article.

As a result of studies and experiments, the present inventors have found that the efficiency of the disclosed process depends, mainly, upon the number of preliminary lays of wires in the preliminary twisting zone (the portion between the feed mechanism and twisting head), for it is only the number of preliminary lays that defines the frequency and, consequently, the period of reversing of the twisting head at one and the same speed of rotation of the latter.

An increase in the length of the zone of preliminary twisting is accompanied by an increase in the number of preliminary lays, however, the dependence between the two parameters in non-linear and, while the successive increments of the length of the preliminary twisting zone remain the same, the corresponding increments in the number of preliminary lays tend to get smaller, therefore, the present inventors arrived at a conclusion on the impracticality of increasing the length of the preliminary twisting zone with a view to increasing the number of preliminary lays, as it is in the prior art processes.

Therefore, in the process according to the present invention provision is made for steps aimed at improving the process efficiency, namely, the preliminary twisting of wires is effected with a shortest permissible pitch over the entire length of the preliminary twisting zone, the number of lays in said zone depending linearily upon the length thereof.

This enables one, without varying the period of reversing, to extend the process capabilities, increase the speed of rotation of the twisting head by several times as compared with prior art processes and improve the quality of finished articles.

It is expedient that subsequent twisting of wires in the zone of preliminary twisting be effected in the direction of preceding untwisting of wires while simultaneously twisting the wires in the same direction in the zone of final twisting. This helps to extend the article portion twisted in a single direction. In addition, the number of reverses is reduced, which helps to double the efficiency.

Another important object of the present invention is attained in a machine for manufacturing twisted wire articles with variable direction of twist, comprising a bed on which are sequentially mounted an unwinding device, guides accommodating a carriage having a reciprocation drive and supporting an auxiliary twisting head with a drive for rotating said head synchronously with a twisting head of a twisting mechanism provided with twisting jaws, with a pull-out mechanism and a take-up mechanism located thereafter.

The provision of the auxiliary twisting head with its rotation drive, mounted on the carriage movable in the guides, makes for twisting the wires in the gap between the unwinding device and twisting mechanism with the shortest permissible pitch, which ensures the maximum number of preliminary lays in said gap and, consequently, helps to increase the length of the article portion twisted in a single direction and raise the machine output.

It is expedient that the rotation drive of the auxiliary twisting head should be an electric drive ensuring the rotation of said auxiliary head synchronously with the twisting head of the twisting mechanism, and that said rotation drive be electrically connected with the drive of the twisting head of the twisting mechanism.

This helps to provide a flexible coupling of the auxiliary twisting head with the twisting head of the twisting mechanism.

It is further expedient that the carriage reciprocation drive should be provided with a tension pulley block and a pulley with an electric drive, said block and pulley being arranged at the guide ends, a flexible member set on said block and pulley and one side of said flexible member secured to the carriage, and that provision be made of a switching means with switches for reversing the electric drive of the carriage in the extreme positions of the latter.

Such an arrangement of the drive helps to ensure the minimum weight of the drive components moving along the machine, for it is only the flexible member that is actually moving in this case.

BRIEF DESCRIPTION OF DRAWINGS

Described hereinbelow for a better understanding of the invention is an embodiment of the process of the invention and machine for accomplishing same, due reference being had to the accompanying drawings in which.

DETAILED DESCRIPTION OF THE INVENTION

Figure 1:
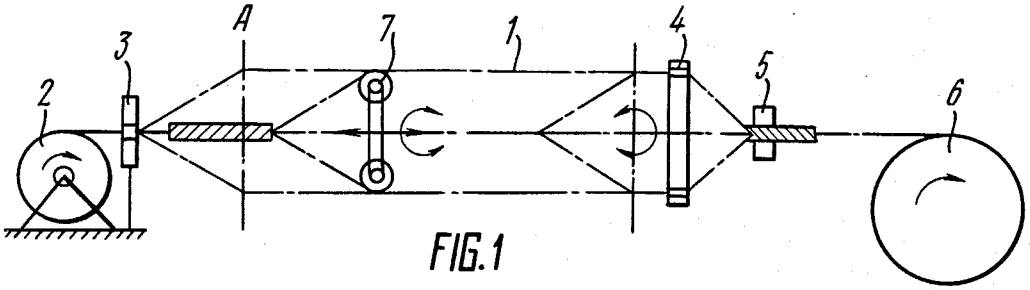
FIG. 1 shows diagrammatically zones with means for preliminary and final twisting of wires, according to the present invention.

The process of the invention for manufacturing twisted wire articles with variable direction of twist provides for a continuous feed of wires 1 (FIG. 1) from bobbins 2 to series-arranged zones of preliminary and final twisting of wires. The zone of preliminary twisting of wires is located between a wire spool 3 and a twisting head 4.

The zone of final twisting of the wires 1 is disposed between twisting jaws 5 and a take-up mechanism 6.

An additional (auxiliary) twisting head 7 helps effect the twisting of wires in the preliminary twisting zone in one of preset directions with an essentially uniform pitch of twisting the wires 1, while simultaneously twisting the wires 1 in the opposite direction in the final twisting zone.

The pre-twisted wires 1 are unwound in the zone of preliminary twisting, while simultaneously twisting the wires 1 in the final twisting zone to form a finished article.

When in the initial position, the additional twisting head 7 is in its extreme left-hand position (A), as shown in FIG. 1.

After switching a drive (not shown in FIG. 1), the twisting head 4 and the additional twisting head 7 are imparted synchronous rotation in one and the same direction. As a result of this rotation, the wires are twisted in opposite directions: in the final twisting zone they are twisted with a constant pitch preset by the rate at which the wires are pulled out by the take-up mechanism 6, while in the preliminary twisting zone they are twisted with a pitch caused by the axial velocity of the additional twisting head 7. The constant rate of displacement of the additional twisting head 7 along the production line makes for a positive twisting of wires in the preliminary twisting zone with a constant pitch, the minimum permissible value of pitch being based on the proviso that the material of wires suffers no deformation because of stresses caused by twisting in said zone.

On reaching the limiting number of lays in the preliminary twisting zone, there occurs a synchronous reversing of the twisting head 4 and additional twisting head 7, as well as a change of the direction of movement of the additional twisting head 7 along the production line. The change in the direction of rotation of the twisting heads 4 and 7 leads to changing the direction of twisting the wires in the final twisting zone and, thereby, to making the direction of twist in the finished article opposite to the direction of twist in the preceding zone, while in the preliminary twisting zone there takes place unwinding (untwisting) of pre-twisted wires.

The rate of movement of the additional twisting head 7 in the reverse direction is such that, by the moment of complete untwisting the pre-twisted wires, said head 7 takes the initial position A. While the head 7 is in this position, the direction of its axial movement is changed to the opposite one while the direction of rotation of the twisting heads 4 and 7 stays unchanged. After that, the additional twisting head 7 moves at a preset rate in the direction of process flow and rotates synchronously with the twisting head 4 to pre-twist wires in a direction opposite to that of preceding preliminary twisting, while in the final twisting zone a finished article is formed in the same direction. The direction of twist in the finished article is only varied upon reversing the twisting heads 4 and 7, which occurs on reaching the limiting number of preliminary lays.

Thus, the additional twisting head 7 rotates and performs reciprocation along the twisting axis at preset rates so that during the time the twisting head 4 rotates in one direction said head 7 acts in the preliminary twisting zone to first untwist and then twist the wires. While so doing, preliminary twisting is done positively at a constant minimum permissible pitch and, in the zone of preliminary twisting, the dependence between the number of lays and the length of the latter zone becomes linear.

Figure 2:
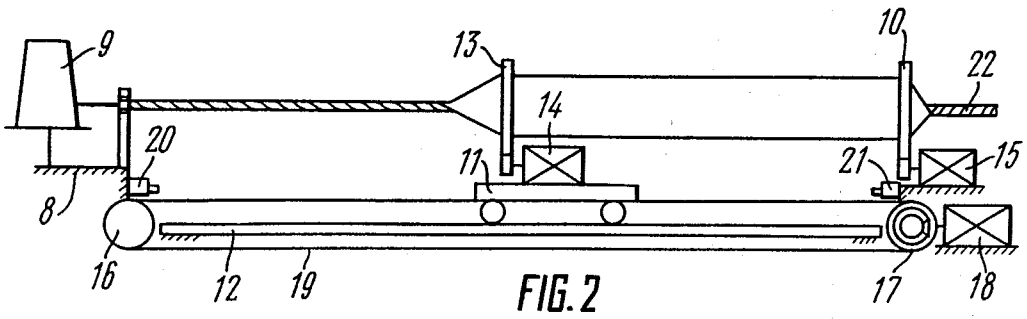
FIG. 2 is a diagrammatic view of the machine for accomplishing the process according to the invention.

The machine of the present invention for manufacturing twisted wire articles with variable direction of twist comprises, sequentially mounted on a bed 8 (FIG. 2), an unwinding device 9, a twisting mechanism with twisting jaws (not shown in the drawing) and a twisting head 10, as well as a mechanism for preliminary twisting of the article wires, a pull-out mechanism and a take-up mechanism (the latter two mechanisms are not shown in the drawing). The mechanism for preliminary twisting of wires comprises a carriage 11 mounted in guides 12 and supporting an auxiliary (additional) twisting head 13 provided with an electric rotation drive 14. For synchronous rotation of the auxiliary twisting head 13 with the twisting (main) head 10 of the twisting mechanism, their respective drives 14 and 15 are electrically interconnected. The carriage 11 is provided with a reciprocation drive comprising a tension pulley block 16 and a pulley 17 with an electric drive 18, said block and pulley being mounted at the ends of the guides 12. Set on the tension block 16 and pulley 17 is a flexible element 19 whose one side is attached to the carriage 11.

For reversing the electric drive 18, provision is made of electric switching means having switches 20 and 21 affected alternately by the carriage 11 in the extreme positions thereof.

The switch 21 can also be used for reversing the electric drives 14 and 15 of the auxiliary twisting head 13 and twisting head 10 of the twisting mechanism. For pulling out a finished article 22, the machine of the invention can be provided with a pull-out mechanism and a take-up mechanism of conventional design (not shown in the drawings).

The machine of the present invention operates in the following manner.

Upon actuating the drive 14 of the auxiliary (additional) twisting head 13 and drive 15 of the main twisting head 10 of the twisting mechanism, said twisting heads rotate synchronously in one and the same direction.

As a result of such rotation, the article wires are twisted in opposite directions as follows: in the zone after the twisting head 10 they are twisted with a constant pitch preset by the rate of pulling out the wires with the aid of a draw-out pulley (not shown in the drawings) while in the zone between the unwinding device 9 and auxiliary twisting head 13 they are twisted with a pitch set by the rate of axial movement of the carriage 11. When the carriage 11 approaches the extreme right-hand position (in the direction of process flow, as shown in the drawing), it affects the switch 21 which, thanks to the appropriate wiring circuit, acts to perform a simultaneous reversing of the electric drives 14 and 15 of the main twisting head 10 and auxiliary twisting head 13, respectively, as well as to switch over the electric drive 18 in an opposite direction but at a decelerated rate ensuring a reduction of the rate of movement of the carriage 11 by the double value of the rate of drawing the wires of the article 22. While so doing, the twisting head 10 starts twisting the article wires in another twisting direction, the carriage 11 moves in the reverse direction (to the left), and the auxiliary twisting head 13 changes the direction of its rotation and starts unwinding (untwisting) the article wires in the gap between the twisting head 13 and unwinding device 9. The process of untwisting the article wires continues until the carriage 11 affects the switch 20 which, with the aid of an appropriate wiring circuit, acts to reverse the electric drive 18 after which the carriage 11 starts moving in the direction of process flow (to the right) towards the twisting head 10, while the auxiliary twisting head 13 rotating on in the same direction starts twisting the article wires. When the carriage 11 approaches its extreme right-hand position, it affects the switch 21 and the cycle is repeated.

As shown by tests, the herein disclosed process and machine ensure an increased efficiency and reduced area required by the machine for accomplishing said process, as well as expanded capabilities of manufacturing twisted articles with variable direction of twist.

For example, with the length of the preliminary twisting zone of 7 to 10 m, the output in manufacturing three-wire ropes with variable direction of twist by the process of the invention in the machine for accomplishing same increased more than five-fold as compared with prior art processes accomplished in prior art machines.

What is claimed is:

1. A process for manufacturing twisted wire articles with variable direction of twist comprising: continuously feeding wires to series-arranged zones of preliminary and final twisting; twisting said wires with a rotating twisting head in one of preset directions in the zone of preliminary twisting while translating the twisting head to obtain an essentially uniform pitch of twist thereby ensuring the maximum number of lays in said zone, while simultaneously twisting the wires in the opposite direction in the zone of final twisting of wires to form an article; and subsequently untwisting the pre-twisted wires in the zone of preliminary twisting by rotating the twisting head in a direction opposite the first direction of rotation while simultaneously translating the twisting head in a direction opposite the first direction of translation and simultaneously twisting the wires in the opposite direction in the zone of final twisting of wires to form an article.

2. A process as claimed in claim 1, wherein twisting of said wires in the zone of preliminary twisting subsequent to the untwisting is performed in the direction of preceding untwisting of said wires while simultaneously twisting the wires in the same direction in the zone of final twisting.

3. A machine for manufacturing twisted wire articles with variable direction of twist, comprising: a bed; an unwinding device, a twisting mechanism with twisting jaws and twisting head, a pull-out mechanism and a take-up mechanism; all sequentially mounted on said bed; guides arranged between said unwinding device and said twisting mechanism; a carriage mounted in said guides and having a reciprocation drive; an auxiliary twisting head mounted on said carriage and provided with a drive for rotating said auxiliary head synchronously with the twisting head of said twisting mechanism.

4. A machine as claimed in claim 3, wherein the rotation drive of said auxiliary twisting head is an electric drive ensuring the rotation of said auxiliary head synchronously with the twisting head of said twisting mechanism and coupled electrically with a drive of the twisting head of said twisting mechanism.

5. A machine as claimed in claim 3, wherein the reciprocation drive of said carriage has, at the ends of said guides, a tension pulley block and a pulley with an electric drive, with a flexible member being set on said block and pulley and one side of said member being attached to said carriage, and wherein provision is made of switching means with switches for reversing the electric drive of said carriage in the extreme positions of the latter.

* * * * *